US008118574B1

(12) United States Patent
Sperry

(10) Patent No.: US 8,118,574 B1
(45) Date of Patent: Feb. 21, 2012

(54) RADIAL SUCTION VALVE ASSEMBLY FOR A COMPRESSOR

(75) Inventor: Lauren D. Sperry, Lake Winnebago, MO (US)

(73) Assignee: ACI Services, Inc., Cambridge, OH (US)

( * ) Notice: Subject to any disclaimer, the term of this patent is extended or adjusted under 35 U.S.C. 154(b) by 382 days.

(21) Appl. No.: 12/573,102

(22) Filed: Oct. 3, 2009

Related U.S. Application Data

(60) Provisional application No. 61/102,637, filed on Oct. 3, 2008.

(51) Int. Cl.
*F04B 39/10* (2006.01)
*F16K 21/04* (2006.01)

(52) U.S. Cl. ..... 417/568; 137/512.15; 137/512.1

(58) Field of Classification Search ..... 417/568; 137/512.15, 512.1
See application file for complete search history.

(56) References Cited

U.S. PATENT DOCUMENTS

| | | | | |
|---|---|---|---|---|
| 894,286 | A | 7/1908 | Reineking | |
| 1,023,885 | A * | 4/1912 | Smyth | 137/512.1 |
| 2,191,968 | A | 2/1940 | Meiser | |
| 2,420,056 | A | 5/1947 | Seligmann et al. | |
| 2,637,519 | A | 5/1953 | Ferrari | |
| 3,165,116 | A | 1/1965 | Rosenschold | |
| 3,422,903 | A | 1/1969 | Jansson | |
| 3,448,766 | A * | 6/1969 | Schule | 137/854 |
| 3,896,848 | A | 7/1975 | Sypitkowski | |
| 4,228,770 | A | 10/1980 | Boyesen | |
| 4,290,454 | A * | 9/1981 | Shetler | 137/853 |
| 5,197,290 | A | 3/1993 | Lee et al. | |
| 5,533,870 | A * | 7/1996 | Takenaka et al. | 417/269 |
| 5,794,654 | A | 8/1998 | Marvonek et al. | |
| 6,554,698 | B2 * | 4/2003 | Kranzdorf et al. | 454/184 |
| 6,607,366 | B2 * | 8/2003 | Sperry | 417/306 |
| 6,899,126 | B2 | 5/2005 | Weigand et al. | |
| 7,011,103 | B2 * | 3/2006 | Delgado | 137/15.18 |

* cited by examiner

*Primary Examiner* — Charles Freay
(74) *Attorney, Agent, or Firm* — Erickson, Kernell, Derusseau & Kleypas, LLC

(57) ABSTRACT

A suction valve for a reciprocating compressor includes a hollow cylindrical valve seat having a plurality of suction ports formed therethrough. The suction ports are covered by flaps moveably mounted on the inner surface of the valve seat which open and close in response to pressure differentials in the compressor. The flaps are oriented in a consistent circumferential direction so as to induce a vortex effect in gas moving through the suction ports.

10 Claims, 6 Drawing Sheets

RADIAL SUCTION VALVE ASSEMBLY FOR A COMPRESSOR

This application claims the benefit of co-pending provisional application Ser. No. 61/102,637 filed Oct. 3, 2008.

BACKGROUND OF THE INVENTION

1. Field of the Invention

This invention relates to valves for reciprocating gas compressors, and in particular to a radial suction valve assembly designed to increase efficiency by creating a vortex effect which increases flow through the valve assembly and keeps at least some valve members of the valve assembly open past bottom dead center of the compressor piston.

2. Description of the Related Art

Reciprocating gas compressors act to move gas from a suction line to a discharge line at increased pressure. These compressors include a piston slidably moveable in a cylinder. Flow from the suction line into the cylinder is controlled by a suction valve assembly and flow from the cylinder into the discharge line is controlled by a discharge valve assembly.

Suction valve assemblies generally include valve members which open and close in response to pressure differentials within the compressor. When the compressor piston is at top dead center (TDC), the suction valve members are closed. As the piston moves away from TDC, pressure within the cylinder decreases. When the cylinder pressure drops below the pressure in the suction line, the valve members open to allow flow from the suction line into the cylinder. The valve members remain open until the piston reaches bottom dead center (BDC), at which point the cylinder pressure is equalized with the suction line pressure and the valve members close.

The efficiency of a reciprocating compressor can be increased by reducing the obstructions to flow across the suction valve and by increasing flow rate through the suction valve assembly. It is therefore desirable to produce a suction valve which has the least possible restriction. It would also be desirable to increase the flow rate or to continue flow past Bottom Dead Center without allowing gas to flow backward from the cylinder into the suction line.

SUMMARY OF THE INVENTION

The present invention is a suction valve assembly which comprises a hollow cylindrical valve seat having radially extending suction ports formed therethrough. The outside of the valve seat is in fluid communication with the suction line, and the inside of the valve seat is in fluid communication with the cylinder. The inside of the valve seat, is covered by a layer of resilient material, such as spring steel, which has a plurality of generally C-shaped cuts formed therein to create flaps which cover the suction ports and serve as sealing members to selectively close the suction ports.

As the piston of the compressor moves downwardly, away from Top Dead Center, gas is pulled from the suction line of the compressor through the suction ports and into the inside of the valve seat. The flaps open in response to pressure differentials to allow the gas to flow into the cylinder. The flaps are all oriented in the same circumferential direction, such that as the flaps open and the gas is pulled through the valve assembly, the gas will swirl, creating a vortex effect. This vortex effect will produce increased flow both by creating suction which pulls more gas in through the suction ports near the cylinder, and by causing the flaps furthest from the cylinder to be delayed in closing, allowing flow to continue past the point of the piston reaching Bottom Dead Center.

DETAILED DESCRIPTION OF THE PREFERRED EMBODIMENTS

Figure 1:
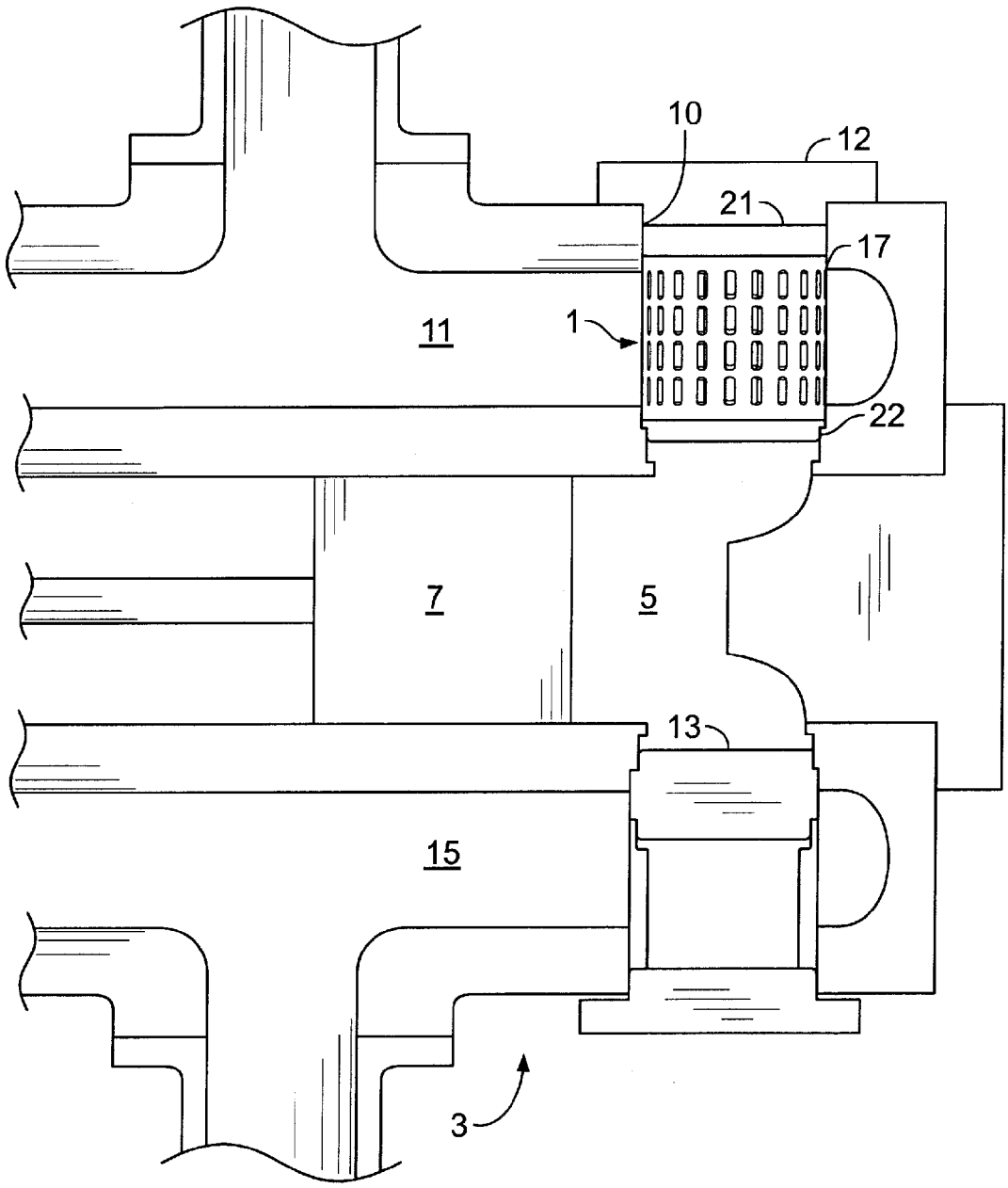
FIG. 1 is a fragmentary cross sectional view of a reciprocating gas compressor showing a radial suction valve according to the present invention installed in a suction pocket thereof.
Figure 2:
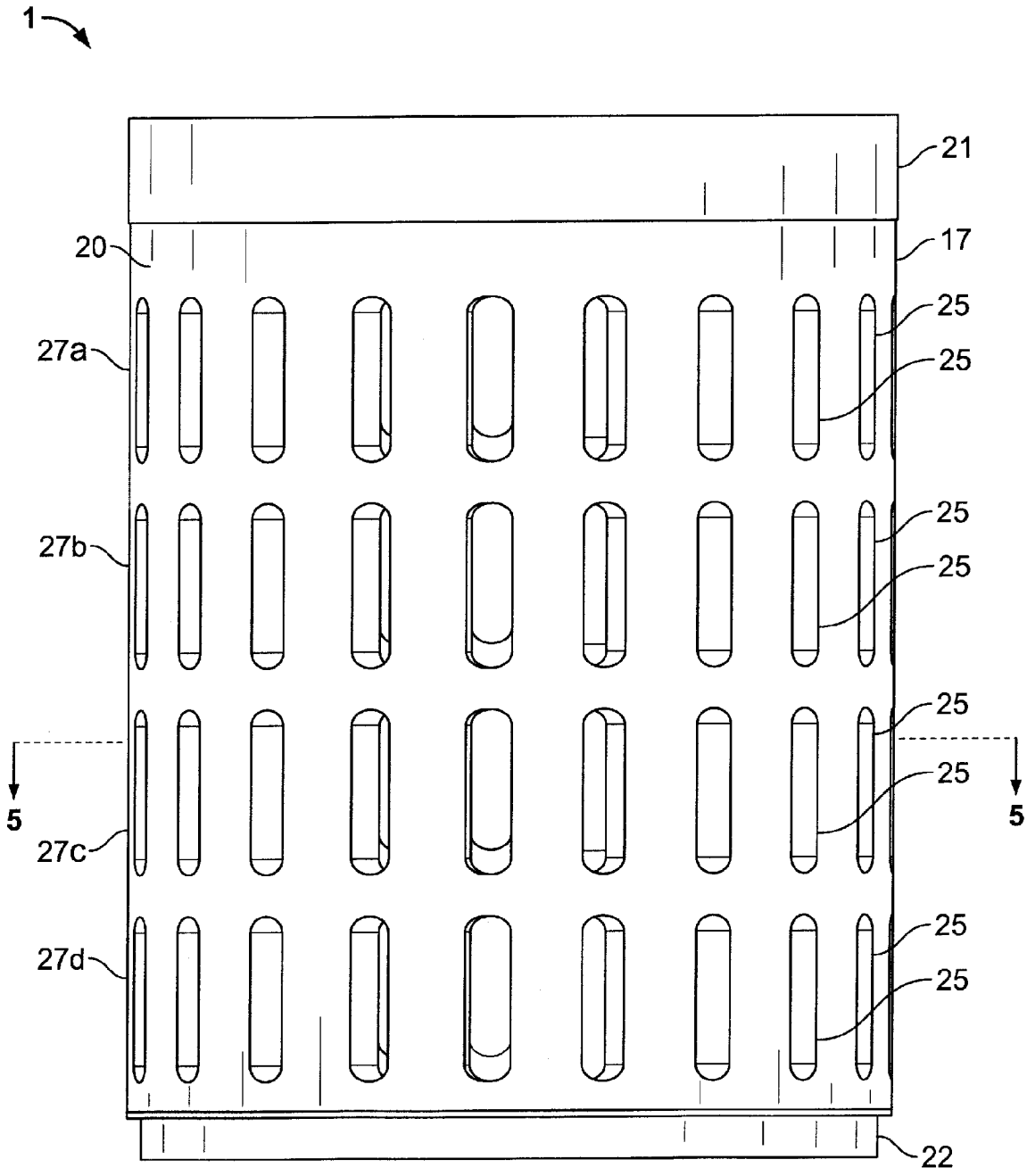
FIG. 2 is a side elevational view of the radial suction valve.
Figure 3:
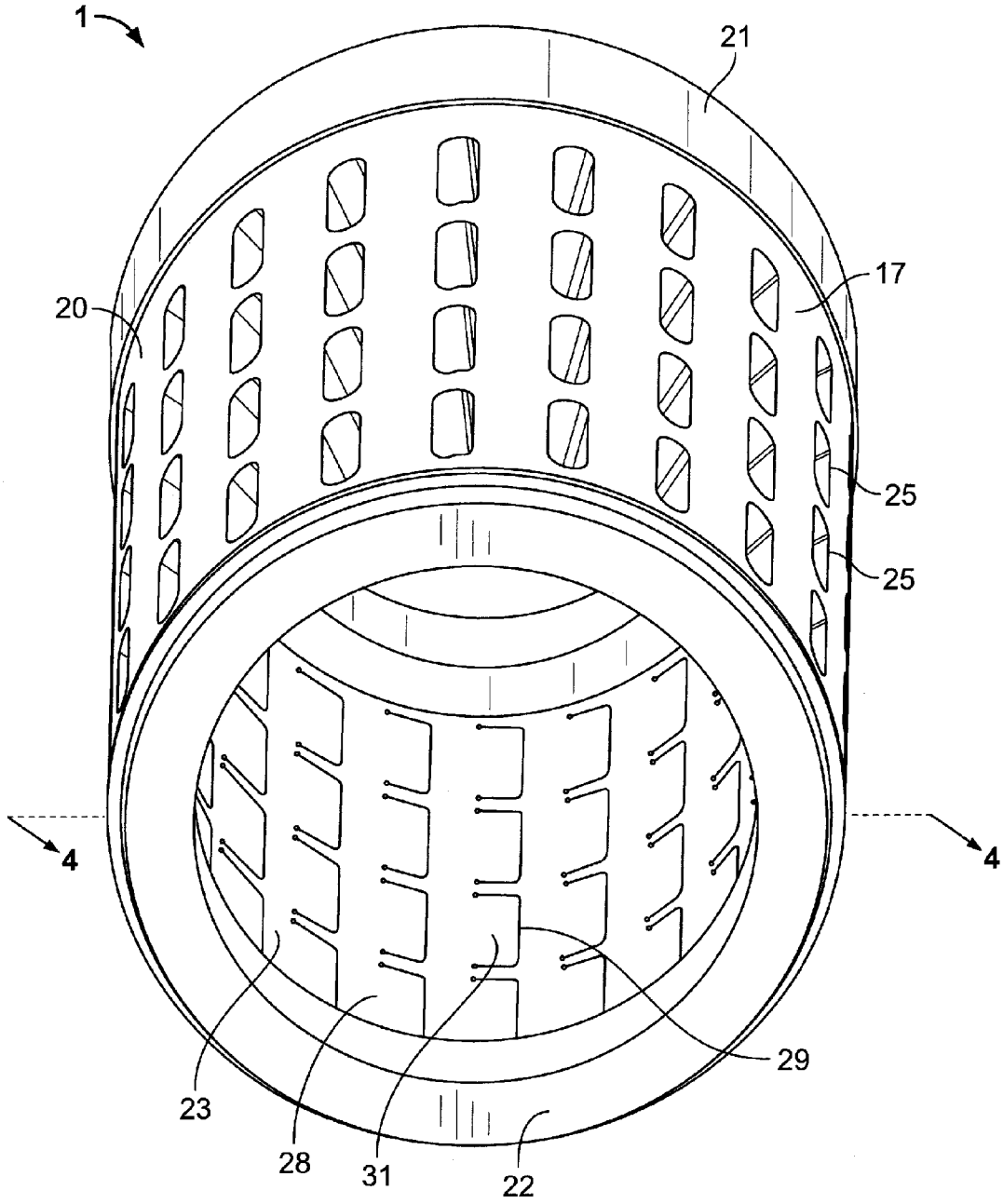
FIG. 3 is a perspective view of the radial suction valve.
Figure 4:
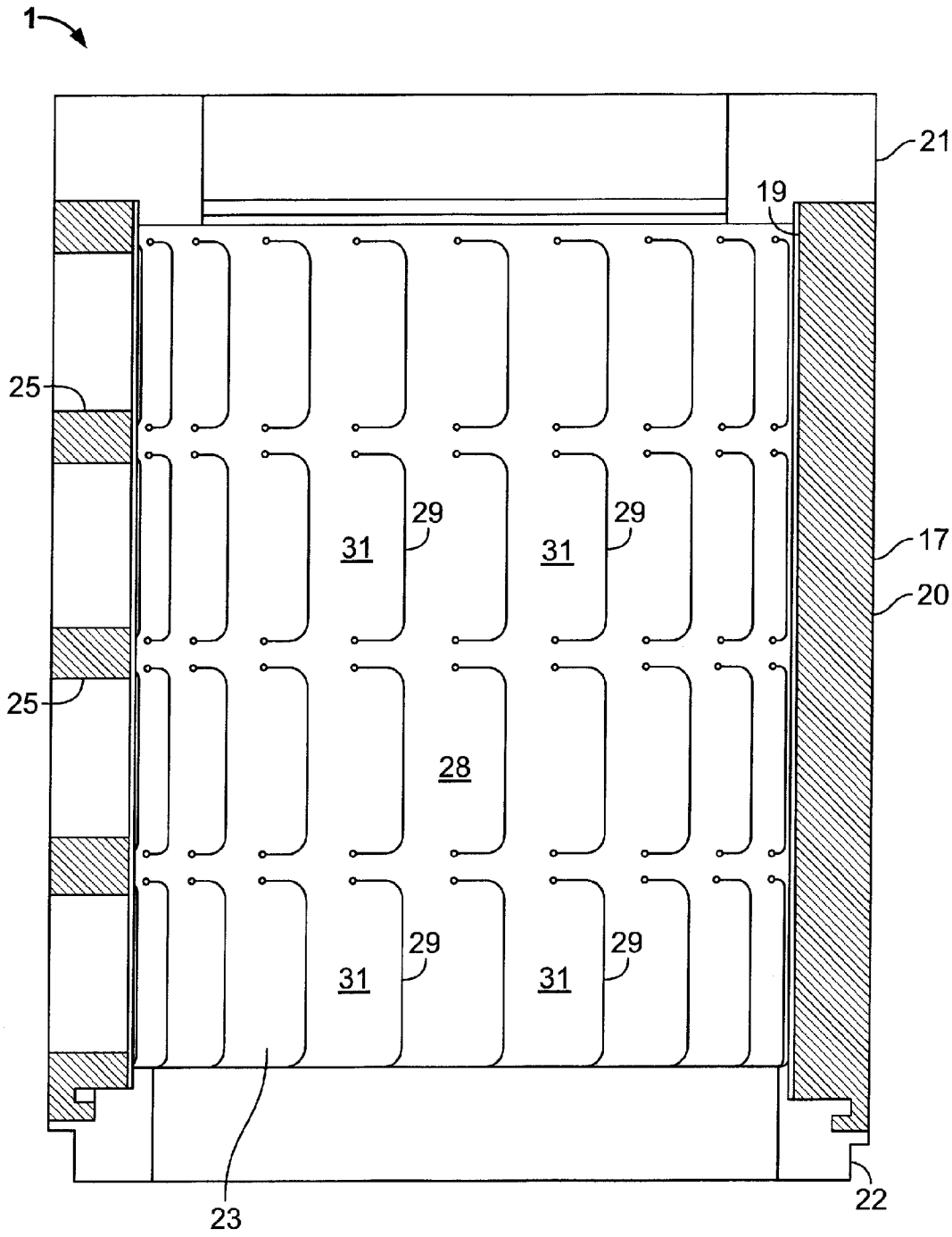
FIG. 4 is a cross sectional view of the suction valve taken generally along line 4-4 in FIG. 3.
Figure 5:
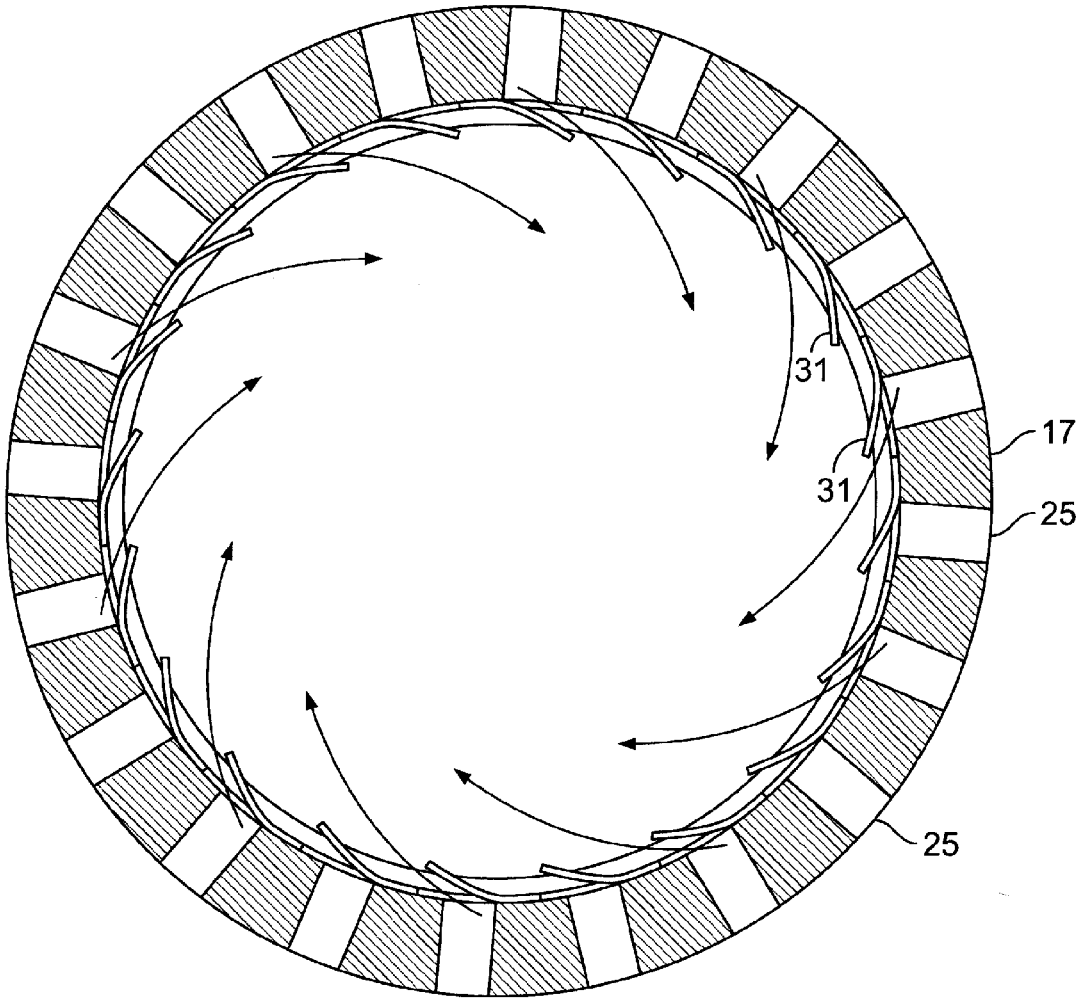
FIG. 5 is a cross sectional view of the suction valve taken generally along line 5-5 in FIG. 2 and showing valve members thereof in an open position.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, and in particular to FIG. 1, the reference number 1 generally designates a radial suction valve assembly according to the present invention. The suction valve assembly 1 is for use on a reciprocating compressor 3 including a cylinder 5 slidably receiving a piston 7 connected to a crankshaft (not shown). The suction valve assembly 1 is mounted in a suction valve pocket 10 of the compressor 3 and selectively communicates the cylinder 5 with a suction line 11. The suction valve 1 is retained in the pocket 10 by a valve cap 12. Similarly, a discharge valve assembly 13 selectively communicates the cylinder 5 with a discharge line 15. The compressor 3 generally operates to move gas from the suction line 11 to the discharge line 15 at increased pressure.

Referring to FIGS. 2-5, the suction valve assembly 1 generally comprises a hollow cylindrical valve seat 17 having an inner surface 19 and an outer surface 20. The assembly 1 may also include first and second annular spacer rings 21 and 22, respectively positioned on opposite ends of the valve seat 17. The inner surface 19 of the valve seat 17 defines an axial passageway 23 which extends between the opposite ends of the valve seat 17. The axial passageway 23 is closed at one end by the valve cap 12 and is open to the cylinder 5 at the opposite end. A plurality of radial ports 25 are formed through the valve seat 17 and extend between the axial passageway 23 and the outer surface 20. The ports 25 are shown as being arranged in a plurality of axially spaced rings 27, designated herein as rings 27*a* through 27*d*, with ring 27*a* being positioned closest to the valve cap 12 and ring 27*d* being nearest the cylinder 5. It should be noted that the ports 25 can be arranged in patterns other than parallel rings if so desired.

Positioned inside the valve seat 17, against the inner surface 19, is a layer of resilient material 28, such as spring steel, having a plurality of generally C-shaped cuts 29 formed therein. The layer of resilient material 28 may be fastened to the valve seat 17 using mechanical fasteners or the like, including machine screws, bolts or rivets (not shown). Each cut 29 in the resilient material 28 defines a flap 31. The flaps 31 are each associated with a respective one of the ports 25 and are positioned in covering relation with the respective port 25. Each flap 31 is moveable between opened and closed positions by flexion of the resilient material. The flaps 31 are cut somewhat larger than the ports 25 such that outer portions of each flap 31 bear against the inner surface 19 of the valve seat 17 when the flap 31 is in the closed position. Each of the cuts 28 is oriented such that the flaps 31 open in the same circumferential direction.

In use, the valve assembly 1 controls flow between the suction line 11 and the cylinder 5. When the piston 7 is at top dead center, the flaps 31 are closed and sealed against the inner surface 19 of the valve seat 17. As the piston 7 moves away from top dead center, pressure in the cylinder 5 decreases until it drops below the pressure in the suction line 11, at which point the flaps 31 open by flexion of the resilient material of which they are formed. As gas moves through the suction ports 25 and into the axial passageway 23, the flaps 31 act as vanes to cause a swirling motion in the gas, creating a vortex effect, as indicated by the arrows in FIG. 5. The vortex effect creates suction which increases the flow rate through the suction ports, particularly in those suction ports closest to the cylinder, and thereby increases the efficiency of the compressor. Furthermore, the suction from the vortex effect exerts a force on the flaps 31 which tends to hold the flaps 31 open. This second result is particularly important as the piston reaches bottom dead center since the vortex effect can keep some of the flaps, particularly those flaps furthest from the cylinder and closest to the end cap, open past bottom dead center and thereby allow gas to continue to flow into the cylinder for a brief time after bottom dead center is reached. This continued flow after bottom dead center also increases the efficiency of the compressor.

The suction valve assembly 1 provides very little obstruction to flow, since there are no moving parts except for the flaps 31, and the flaps open easily once the proper pressure differentials are achieved. It is believed that the gas flowing through each suction port 25 will act as a stop or cushion for the flap 31 associated with the adjacent port 25 and, in this manner, the flaps 31 will be prevented from opening too far. The lack of any mechanical stops for the flaps 31, also helps provide a unobstructed flow path for the gas passing through the suction valve assembly 1.

It is also believed that the suction valve assembly 1 of the present invention can act as a venturi and that additional gas will therefore be pulled through the assembly 1 as the result the Bernoulli Effect. This is because the combined area of the ports 25 is greater than the area of the passageway 23, and as gas flows from the ports 25 and through the passageway 23, the flow becomes constricted proximate the ring of ports 27*d* nearest the piston 7 and furthest from the valve cap 12, forming the throat of a venturi. In the area of the throat, the velocity of the flow is increased and the static pressure is decreased. This decrease in pressure will act to pull more gas through the ports 25 in ring 27*d* than would otherwise be possible.

Figure 6:
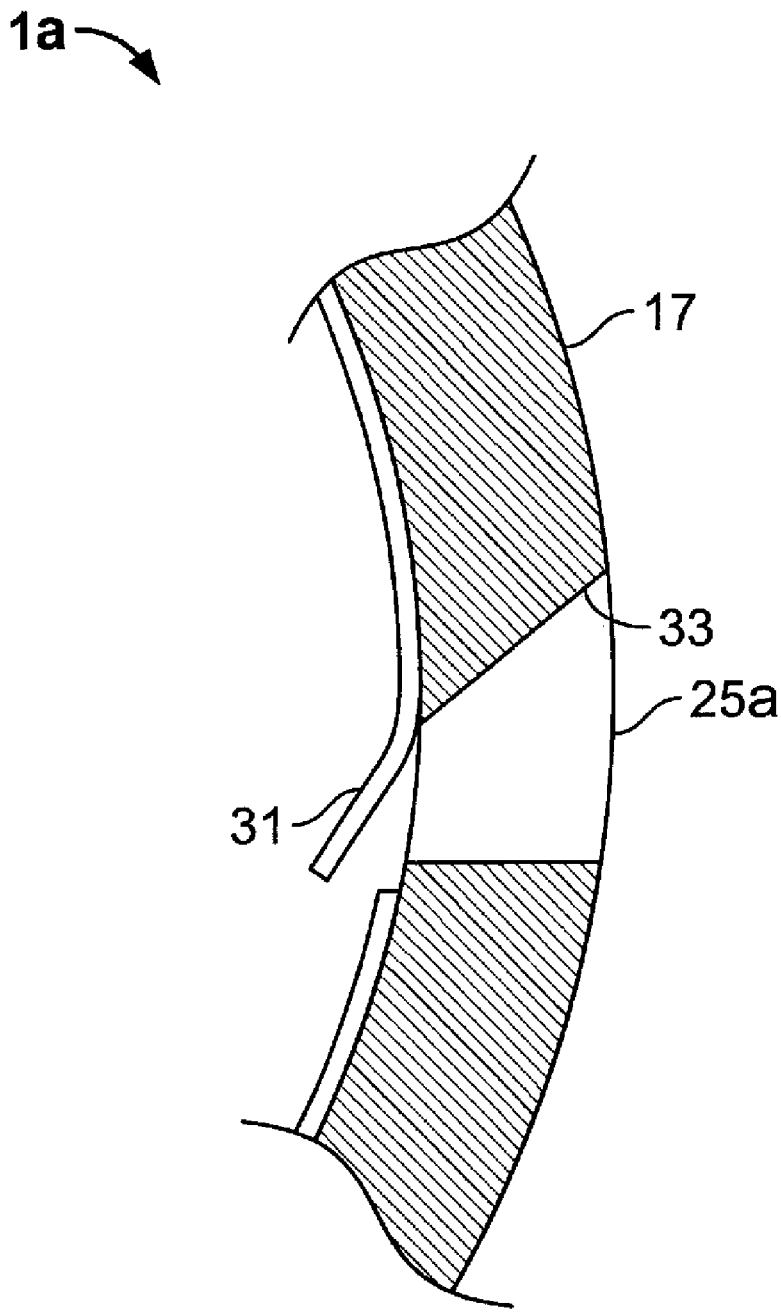
FIG. 6 is a fragment of a cross sectional view similar to FIG. 5 showing an alternative embodiment of the suction valve assembly.

FIG. 6 shows an alternative embodiment of the suction valve assembly 1, denominated as valve assembly 1*a*, which includes ports 25*a* (one shown) arranged in the same manner described above. The ports 25*a* are similar to the ports 25, except that a first wall 33 thereof is angled inwardly toward the hinged side of the respective flap 31. The angle of the wall 33 allows the gas to flow in a more direct path, and contributes to the vortex effect that is produced by the flaps 31 all pointing the same direction. While not essential to the operation of the suction valve assembly, this feature gives the gas a smoother flow path, as it flows through the valve seat 17 along the angled wall 33 and then through the flap 31 without having to make a substantial change in direction.

It is to be understood that while certain forms of the present invention have been illustrated and described herein, it is not to be limited to the specific forms or arrangement of parts described and shown. For example, it is foreseen that the flaps 31 could be attached to the valve seat 17 by hinges or the like and need not necessarily be formed as cut-outs in a layer of resilient material or rely on flexion of such a material for their ability to move between open and closed positions. If hinges were used to mount the flaps 31 biasing means, such as springs, could be used to bias the flaps toward their closed positions.

As used in the claims, identification of an element with an indefinite article "a" or "an" or the phrase "at least one" is intended to cover any device assembly including one or more of the elements at issue. Similarly, references to first and second elements is not intended to limit the claims to such assemblies including only two of the elements, but rather is intended to cover two or more of the elements at issue. Only where limiting language such as "a single" or "only one" with reference to an element, is the language intended to be limited to one of the elements specified, or any other similarly limited number of elements.

What is claimed and desired to be secured by Letters Patent is as follows:

1. A suction valve assembly for a reciprocating compressor comprising:

a) a hollow cylindrical valve seat having an inner surface and an outer surface, said inner surface defining an axial passageway;

b) a plurality of suction ports extending radially through said valve seat from said inner surface to said outer surface;

c) a plurality of flaps hingedly connected along a first side thereof to said inner surface of said valve seat, each of said flaps associated with a respective one of said suction ports and moveable between open and closed positions relative to the respective suction port, said flaps opening in a single circumferential direction such that in the open position said flaps act as vanes to induce a swirling motion in a gas passing through said suction ports and create a vortex.

2. The suction valve assembly as in claim 1 wherein said flaps comprise cut-outs formed in a layer of resilient material positioned adjacent said inner surface of said valve seat.

3. The suction valve assembly as in claim 1 wherein said suction ports through said valve seat are arranged in a plurality of axially spaced rings.

4. The suction valve assembly as in claim 1 wherein each of said suction ports through said valve seat includes a first wall which is inwardly angled toward said first side of the respective flap.

5. A suction valve assembly for a reciprocating compressor comprising:

a) a hollow cylindrical valve seat having an inner surface and an outer surface, said inner surface defining an axial passageway;

b) a plurality of suction ports extending radially through said valve seat from said inner surface to said outer surface;

c) a layer of resilient material positioned against said inner surface of said valve seat, said resilient material having a plurality of generally C-shaped cuts formed therein to define flaps, each of said flaps associated with a respective one of said suction ports and moveable between open and closed positions relative to the respective suction port, said flaps opening in a single circumferential direction such that in the open position said flaps act as vanes to induce a swirling motion in a gas passing through said suction ports and create a vortex.

6. The suction valve assembly as in claim 5 wherein said suction ports through said valve seat are arranged in a plurality of axially spaced rings.

7. The suction valve assembly as in claim 5 wherein each of said flaps includes a first side which is hingedly connected to said layer of resilient material and said suction ports each includes a first wall which is inwardly angled toward the first side of the respective flap.

8. A reciprocating gas compressor comprising:

a) a cylinder;

b) a piston reciprocably mounted in said cylinder and cyclically moveable between a top dead center position and a bottom dead center position;

c) a rotatable crankshaft connected to said piston;

d) a suction line;

e) a discharge line;

f) a suction valve assembly selectively communicating said cylinder with said suction line, and g) a discharge valve assembly selectively communicating said cylinder with said discharge line; wherein h) said suction valve comprises:

i) a hollow cylindrical valve seat having an inner surface and an outer surface, said inner surface defining an axial passageway;

ii) a plurality of suction ports extending radially through said valve seat from said inner surface to said outer surface; and iii) a layer of resilient material positioned against said inner surface of said valve seat, said resilient material having a plurality of generally C-shaped cuts formed therein to define flaps, each of said flaps associated with a respective one of said suction ports and moveable between open and closed positions relative to the respective suction port, said flaps opening in a single circumferential direction such that in the open position said flaps act as vanes to induce a swirling motion in a gas passing through said suction ports and create a vortex.

9. The reciprocating gas compressor as in claim 8 wherein said flaps close in response to a low pressure differential between said cylinder and said suction line; said pressure differential being lowest when said piston is in said bottom dead center position.

10. The reciprocating gas compressor as in claim 8 wherein said vortex effect created when said flaps are open creates suction sufficient to keep at least some of said flaps open past a point where said piston reaches said bottom dead center position.

* * * * *